United States Patent [19]

Reisacher

[11] 3,949,710

[45] Apr. 13, 1976

[54] STEAM GENERATOR

[75] Inventor: Raimund Reisacher, Erlangen, Germany

[73] Assignee: Siemens Aktiengesellschaft, Munich, Germany

[22] Filed: Nov. 16, 1973

[21] Appl. No.: 416,369

[30] Foreign Application Priority Data

Nov. 17, 1972 Germany ..... 2256633

[52] U.S. Cl. ..... 122/34; 165/143; 165/145; 165/158

[51] Int. Cl.[2] ..... F22B 1/02

[58] Field of Search ..... 122/34, 491; 165/143, 176

[56] References Cited

UNITED STATES PATENTS

| | | | |
|---|---|---|---|
| 1,757,136 | 5/1930 | Pabodie | 165/143 |
| 2,612,350 | 9/1952 | Stadler | 165/163 |
| 3,544,424 | 12/1970 | Mayer et al. | 122/34 |
| 3,734,176 | 5/1970 | Haghaver | 165/143 |

FOREIGN PATENTS OR APPLICATIONS

| | | | |
|---|---|---|---|
| 640,680 | 7/1950 | United Kingdom | 165/143 |
| 1,217,705 | 12/1970 | United Kingdom | 165/143 |

*Primary Examiner*—Albert W. Davis, Jr.
*Assistant Examiner*—James D. Liles
*Attorney, Agent, or Firm*—Kenyon & Kenyon Reilly Carr & Chapin

[57] ABSTRACT

A steam generator, particularly for a pressurized-water coolant nuclear reactor, has two U-shaped tube bundles vertically positioned with their legs end-to-end and with their inlet and outlet ends mutually registered and each individually provided with a tube sheet separate from the others and releasably interconnected by common inlet and outlet primary medium chambers and connections. Each tube bundle is enclosed by a U-shaped jacket having its ends connected to and closed by the respective tube sheets and means are provided for flowing the secondary medium through the two jackets in series.

3 Claims, 6 Drawing Figures

STEAM GENERATOR

BACKGROUND OF THE INVENTION

One typical steam generator for a pressurized-water coolant nuclear reactor includes a vertical jacket having a steam output outlet in its top, the jacket's bottom being closed by a horizontal tube sheet in which the inlet and outlet ends of an inverted U-shaped tube bundle are mounted, the jacket having a feed water inlet, the water being the secondary medium, and from which steam is generated. Primary medium chambers beneath the tube sheet provide for passing the pressurized-water coolant through the tube bundle via its inlet and outlet ends. To provide high steam generating capacity, the jacket, tube bundle and its tube sheet have large diameters to a degree undesirable from the manufacturing, transportation and erection cost.

Another type of steam generator is disclosed by the journal "Nuclear Engineering", October 1957, pages 433 and 435. In this form two horizontal U-shaped tube bundles are used, positioned end-to-end, inside of a single horizontal cylindrical jacket which encloses both legs of both tube bundles. This means that the jacket must be large enough in diameter to enclose both bundle legs in each instance, and the arrangements for connecting the opposite legs involve undesirable complications.

SUMMARY OF THE INVENTION

The object of the present invention is to provide a pressurized-water coolant nuclear reactor steam generator construction permitting the use of smaller diameter jackets and tube sheets, and permitting the generator to be made from separate units of relatively small transverse dimensions and light weight and which may be assembled at the nuclear reactor installation and, if necessary, disassembled for repair work, the relative statements made herein being as compared to the vertical generator type and the horizontal type referred to hereinabove.

In the construction of the present invention, two U-shaped tube bundles are also used but these are arranged vertically one above the other with their legs arranged end-to-end. Each bundle leg is provided with its own separate tube sheet, meaning there are four tube sheets, and these may all be of identical construction and inherently are of relatively small diameter, contributing to manufacturing economy and, incidentally, providing for a reduction in operating stress problems because of their relatively small size. Each tube bundle is enclosed by a U-shaped jacket conforming in contour to the enclosed U-shaped tube bundle and having corresponding legs with ends closed by and connected with the respective tube sheets in each instance. These jacket legs are, therefore, of relatively small diameter throughout their extents and the jackets, tube bundles and tube sheets may be integrated to form two relatively easily transportable units. The tube sheets for the inlet ends of the legs of the two tube bundles register with each other as do the two tube sheets for the bundles' leg's outlet ends, and in each instance these tube sheets are removably interconnected, as by bolts and nuts, by primary medium or pressurized-water coolant, inlet and outlet chambers appropriately positioned and respectively having inlet and outlet coolant connections. This permits easy erection of the generator at the reactor installation.

Each unit has a long and short leg, relative to each other, each leg comprising the jacket and enclosed tube bundle leg, and the two units are arranged so that via the interconnecting chambers the short leg of one unit connects with the long leg of the other unit, the chamber interconnecting the long leg of the lower unit and the short leg of the upper unit forming the primary medium inlet, and the chamber interconnecting the short leg of the lower unit and the long leg of the upper unit forming the primary medium outlet of the generator. The secondary medium or feed water inlet of the generator is via the short leg of the lower unit adjacent to its tube sheet, the secondary medium flowing through the lower jacket counter to the coolant flow in its tube bundle until near the tube sheet of the lower unit's long leg where it is removed via an outlet and through an external water separator, separated steam being introduced to the upper unit adjacent to the latter's top or bend where it flows counter to the upper unit's primary medium flow to a steam output outlet for the upper unit's short leg and which is adjacent to the tube sheet at that location. Water separated by the water separator is transported via an external relatively long vertical gravity pipe down to a secondary medium inlet for the upper unit located adjacent to the tube sheet of this long leg and travels up therethrough to join with the steam separated by the water separator.

With this new construction, as used for pressurized-water coolant nuclear reactors, the coolant enters the inlet chamber and is diverted both upwardly and downwardly so that it flows through the inlet ends of the tube bundles of both units, the coolant exiting via the outlet chamber which interconnects the short leg of the lower unit and the long leg of the upper unit. Feed water introduced to the shorter leg of the lower unit forms a counterflow relative to the coolant, becomes highly preheated and boils, it then entering the external water separator which is connected to feed the separated steam to the top of the upper unit, the separated water feeding to the lower end of the long leg of the upper unit where the separated water flows upwardly and converts substantially entirely to steam which mixes with the steam passed by the water separator and introduced to the top of the upper unit. Superheating is then affected as the steam passes through the remainder of the upper unit to the latter's steam output outlet.

For maximum efficiency, the long leg of the lower unit, including its steam bundle leg, is made shorter than the corresponding long leg of the upper unit, the latter being the longer leg, the short legs being appropriately dimensioned. The relative lengths involved are proportioned to obtain the desired preheating in the lower of the one of the units with final complete conversion of steam in the upper unit together with steam superheating. In the upper unit there is a forced upward flow of the steam generating water because it is provided via the long vertical pipe receiving the water from the water separator and which provides the gravity force of the hydraulic head applied to the separated water fed to the lower end of the long leg of the upper unit.

A specific example of the invention is disclosed herein below with the aid of the accompanying drawings, and which provides other desirable features.

DETAILED DESCRIPTION OF THE INVENTION

Figure 1:
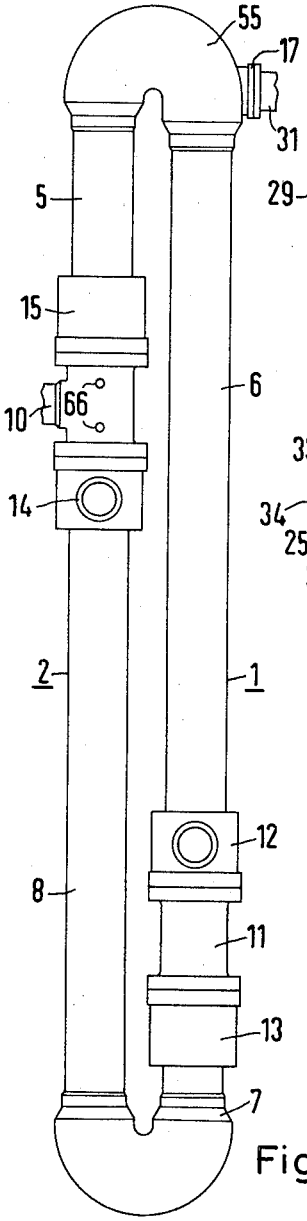
FIG. 1 is an elevation view of the new steam generator with the external water separator arrangement eliminated for clarity.

Having reference to the above drawings, the upper and lower units 1 and 2, respectively, are positioned with their vertical axes in the same vertical plane and each comprises separate cylindrical legs joined by 160° bends or returns, and are of generally cylindrical cross section throughout. The two U-shaped tube bundles are not shown in detail but are illustrated by broken lines in FIG. 6 at 3 and 4, the upper bundle 3 having a short leg 5 and a long leg 6 joined by a 160° bend, the lower bundle 4 having a short leg 7 and a long leg 8 joined by a corresponding bend. The short leg 5 is registered with the long leg 8 and the short leg 7 is registered with the long leg 6. The two units are interconnected by an inlet chamber 10 and an outlet chamber 11 for the primary medium or pressurized-water coolant removed from the reactor and under pump pressure sent to the chamber 10 and returned from the chamber 11. The entire generator is oriented vertically.

For the secondary medium the jacket 1a of the long leg of the unit 1 has an inlet 12 forming a lower intermediate inlet and the jacket **2*a* of the short leg of the unit 2 has a feed water main inlet 13, the jacket of the long leg of the unit 2 having an intermediate outlet 14, and that of the short leg of the unit 1 having a steam output or secondary medium main outlet 15. In addition, the bend of the jacket of the upper unit 1 has an inlet 17 forming an upper secondary medium intermediate inlet fed by the steam line of the external steam-water separator 20 comprising a coarse separator 21 and a fine separator 22**.

This separator 20 is connected with the intermediate outlet 14 of the lower unit 2 by way of a connection 25 and the separator's water outlet is designed as a long vertical gravity pipe or tube 26 which at its bottom end connects with the lower intermediate inlet 12 of the upper unit 1, preferably via a pump **12*a*. With this tube or pipe 26 filled with water from the separator, a hydraulic head is obtained which by gravity, possibly assisted by the pump 12*a*, forces the separated water through the inlet 12 of the upper unit 1. Also, the steam-water separator 20 forms a connection between the two units 1 and 2 via connections 25 and 17 so that the secondary medium flow through the two units is in series. The separator 20 is physically positioned externally parallel to the long leg of the unit 1**.

Figure 4:
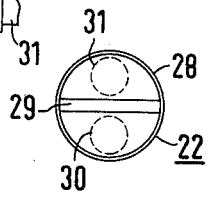
FIG. 4 is a cross section taken on the line 4—4 in FIG. 2.

The fine separator 22 may contain in its vertical cylindrical jacket 28, a filter bed 29 forming a vertical separating wall and consisting of baffles with connecting channels interleaved with each other in zig-zag fashion, these details not being specifically illustrated. As indicated by FIG. 4, the connection 30 between the coarse separator 21 and the fine separator 22 feeds to the jacket 28 on one side of the filter bed 29, passes through this bed and exits via a steam line 31 which connects with the inlet connection 17, separated water being drawn out at various levels via pipes 32 and introduced to the top of the long vertical gravity pipe 26 which feeds this secondary medium via the inlet 12, preferably with the pump **12*a* assisting the gravity force, to the bottom end of the long jacket of the long leg of the unit 1. Although not shown, chokes can be used in conjunction with the various connections 17, 25 and 26** to obtain the most advantageous flow velocities at these locations.

Figure 5:
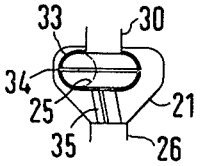
FIG. 5 is a vertical section taken on the line 5—5 in FIG. 2.

The coarse separator 21 is constructed as a centrifugal separator as generally indicated by FIG. 5. It contains a slotted spheroidal spiral 33 from which steam is lead upwardly through the line 30. The water-steam mixture leaving the top of the long leg of the unit 2, via the outlet 14, is eccentrically connected by the connection 25 to the chamber of the coarse separator 21 and is thrown out of the slot 34 of the spheroidal spiral 33 by centrifugal force and pushed towards the inside of the housing 21 from which it falls into the vertical long gravity tube 26, to which it is guided by guide vanes 35, and here any entrapped steam can still flow off into the line 30.

Figure 6:
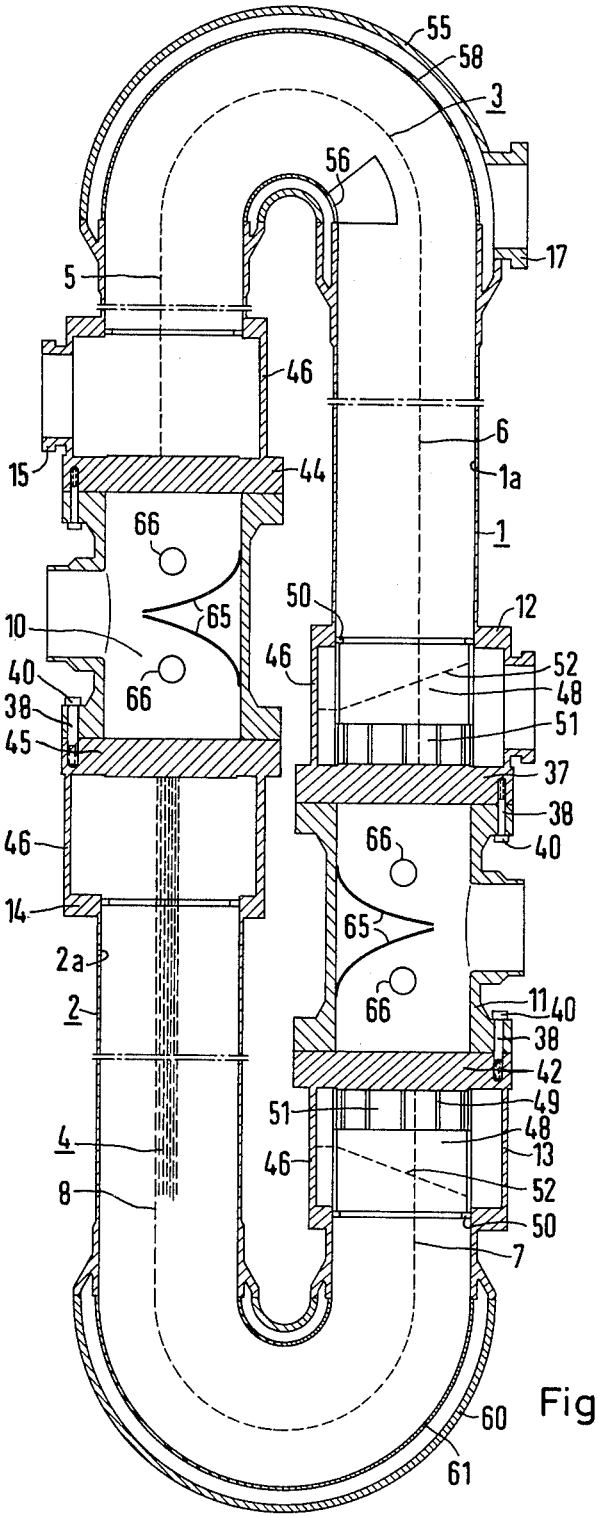
FIG. 6 on an enlarged scale relative to the preceding figures, is a vertical section of the steam generator.

In FIG. 6, to compact this large scale view, the legs of the two units are broken at various points as indicated.

In this figure the jacket **1*a* of the long leg of the unit 1 has its lower end closed by a tube sheet 37 in which the end of the long leg 6 of the tube bundle 3 is mounted. This end of the jacket may be welded to the housing of the inlet connection 12 and the latter integrated with the tube sheet by welding, but the tube sheet itself is releasably or detachably fastened to the primary medium outlet housing 11 by bolts 38 and nuts 40. The jacket 2*a* forming the upstanding short leg of the lower unit 2 is also closed by a tube sheet 42, and this tube sheet and the jacket of the short leg of the unit 2 may also be integrated by welding but with the tube sheet 42 connected to the primary medium outlet 11 by releasable bolts 39 and nuts 40**.

In the same way at the housing of the primary medium inlet 10, the jacket of the short leg of the upper unit 1 is provided with a closing tube sheet 44 while the long leg of the unit 2 has the end of its jacket closed at that location by a tube sheet 45. It is to be understood that in all instances the ends of the tube bundles are mounted in the tube sheets and that the latter may be integrally connected, as by welding, with the respective jackets of the units 1 and 2, but that the tube sheets connect with the primary medium inlet and outlet chambers via releasable fastenings such as the bolts 38 and the nuts 40 indicated at the points of separation. The inlet and outlet chambers interspace the tube sheets connected to them.

Now it can be seen that the units 1 and 2 are releasably connected together. The four tube sheets required may all be identical and this together with their small size permits substantial economies to be effected in connection with their manufacture. The new steam generator can provide output ratings required today while, when disassembled, keeping all of the parts of the steam generator small enough to be transported without undue difficulty through the usual material air lock of the currently conventional containment system in the reactor building where the steam generators are normally installed. After assembly there, by disassembling the parts, the steam generator can be removed through the air lock for repair or replacement when required.

Because of the vertical arrangement an operating efficiency of a high order is obtainable. The feed water introduced via the feed water inlet 13 becomes highly preheated in the lower unit 2 and steam generated enters the top of the upper unit 1 where it mixes with steam generated in the long leg of the unit 1 from the highly heated water from the separator 20, introduced to the bottom of this leg via the gravity pipe 26 in which the column of separated water is maintained. By the force of the gravity, possibly aided by the pump 12*a*, this separated water is forced into the bottom end of the long leg of the unit 1. Even without the pumps, gravity forms a driving force for the secondary medium introduced into the inlet end of the upper unit 1, the water column in the gravity pipe 26 exerting a greater pressure than the water evaporating in the long leg of the unit 1. This force on the water partly overcomes the high flow resistance at the inlet 12, resulting from the flow interference of the tubes of the tube bundle at that location. The steam generated in the long leg of the unit 1 and the steam introduced to its upper end via the inlet 17 from the steam-water separator 20 have approximately the same velocity when they combine at the upper end of the long leg of the unit 1. Because of the weight differences between the water in the gravity pipe 26 and in the long leg of the unit 1, risk of flooding of the steam-water separator 21 is largely avoided; such flooding is positively prevented if the pump 12*a* is used. In the bend of the unit 1 and in its short leg, effective superheating is obtained to provide a high steam flow velocity with consequent good heat transfer characteristics, the inlet 17 being spaced above the outlet 15 adjacent to the inlet tube sheet 44, providing for a travel path of substantial length for superheating.

To obtain a uniformly distributed flow of the secondary medium through the inlet and outlet chambers 12, 13, 14 and 15, the housings of these chambers are formed with cylindrical side walls 46, in each instance, which are eccentrically offset relative to the cylindrical jacket legs connected to them and the enclosed tube sheets and tube bundle legs. For the inlet chambers, the eccentricity comprises an offset in a direction counter to the flow, while for the outlet chambers the offset is in the direction of the flow. For the same purpose each of the inlet chambers 12 and 13 may be provided with an apron 48 pushed by rods 49 against a step 50 formed inside of the chamber, the apron being arranged so that the secondary medium must enter the gap 51 formed by the apron so that the flow is distributed more uniformly. Guide vanes, generally indicated at 52, at the inside walls 46 of the two inlets, may also be used.

The connection 17 of the steam line 31 from the watersteam separator, is preferably lead to the inside of the 180° bend 55 above the tube sheet 44 of the jacket 1a. This jacket 1a at its bend has openings 56 formed in a flow guide tube 58 which surrounds the bend of the tube bundle 3, the connection 17 connecting with a space between this guide tube 58 and the inside of the bend of the jacket 1a and this space connecting with the openings 56. Only one of these openings 56 is shown in FIG. 6, but as many may be provided as are required.

The lower unit 2 has a corresponding bend 60, the bends 55 and 60 both being resistant to pressure. A guide tube 61 is also provided for this bend 60 of the lower unit.

At the inlet and outlet chambers 10 and 11 for the primary medium, oppositely curved diverting baffles 65 are positioned. The primary medium introduced to the chamber 10 is thus smoothly diverted without loss in opposite directions for flow in opposite directions through the tube bundles of the two units; the primary medium flows rejoin smoothly at the outlet chamber 11. These chambers may be provided with appropriately positioned handholds 66 to permit internal repairs if necessary.

Figure 2:
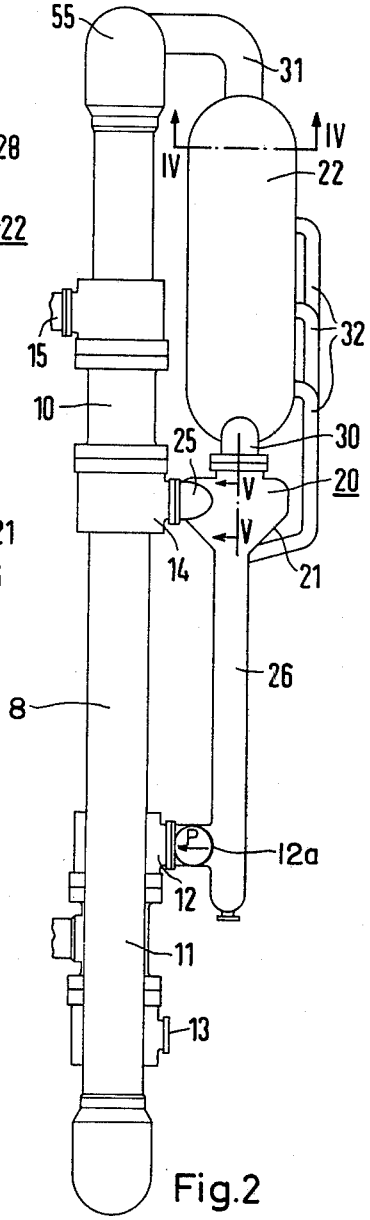
FIG. 2 is also an elevation view of this steam generator but as rotated 90° in a right hand direction, this permitting a showing of the external water separator arrangement.
Figure 3:
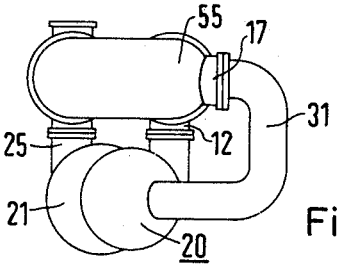
FIG. 3 is a top view of FIG. 1 with the external water separator arrangement included.

In the example of the invention illustrated by the drawings, the short legs 5 and 7 of the tube bundles 3 and 4 are in each instance about one-half as long as the long legs 6 and 8. The long legs of the two units are not equal as is shown by FIGS. 1 and 2 and as has previously been noted, the short legs of the two units, therefore, being of unequal lengths. The short leg 5 is about twice as long as the short leg 7 in view of the amount of heat to be transferred. These length relationships can be varied to achieve optimum conditions for various pressures and temperatures. For the data of existent pressure-water reactors, the illustrated length ratios are considered to be particularly advantageous.

The operation of the new steam generator is briefly summarized as follows:

With the steam generator associated with a pressurized-water coolant nuclear reactor, the coolant flow enters the inlet chamber 10 where it diverts the flows in parallel through the two U-shaped tube bundles 3 and 4 via the tube sheets 44 and 45, leaving the tube bundles via the tube sheets 37 and 42 and outlet chamber 11, where it is drawn off by the main reactor coolant pump for return to the reactor. The feed water is fed only to the inlet chamber 13 where it first flows downwardly in the leg 7 for preheating, evaporation occurring in the other leg 8 of the lower unit 2 so that a water-steam mixture flows into the separator 20 via the outlet chamber 14 and the connection 25. Highly heated water from the separator under the gravity force of the vertical pipe or tube 26 enters the inlet chamber 12 of the long leg of the upper unit 1, separated steam going via 31 and 17 to the bend at the top of this unit 1. The separated water is evaporated in the long leg of the upper unit 1 by the leg 6 of the tube bundle 3, the two streams of steam coming together in the bend and proceeding down through the short leg 5 of the upper unit for preheating, the preheated steam leaving via the outlet chamber 15.

The bends of the jackets of the units 1 and 2 are shown as though they are integrally connected with the jacket legs in each instance. However, although not shown, the jacket bends may in each instance be separably fastened to the jacket legs by providing the respective parts with flanges held together by releasable bolts and nuts.

To make this new steam generator, the legs of the tube bundles may be inserted in the cylindrical tubular jacket legs and installed in the tube sheets. The bends 55 and 60 may be formed in each instance as two halves or shells joined to each other and to the jacket legs by welding. Although not shown, the two halves of the bends may be provided with flanges and bolted together to permit disassembly for repair work on the tube bundles.

What is claimed is:

1. A steam generator comprising two U-shaped tube bundles each having two legs interconnected by a bend, the legs of each of said bundles respectively forming inlet and outlet ends for a primary medium and said two bundles being positioned with their respective inlet legs end-to-end in interspaced relationship and their respective outlet legs end-to-end in interspaced relationship, a separate individual tube sheet for each of said ends, in each instance one of said ends of said legs being mounted in one of said tube sheets, the tube sheets being interspaced, a common primary medium inlet connection chamber interconnecting the interspaced tube sheets in which said inlet tube bundle ends are mounted and a common primary medium outlet chamber interconnecting said interspaced tube sheets in which said outlet tube bundle ends are mounted, each of said tube bundles being enclosed by a separate U-shaped jacket having legs connected with and closed by said tube sheets for the bundles' said leg ends, and means for passing a secondary medium through said jacket; said tube bundles and their said jackets being vertically arranged with a first one of said jackets and said tube bundle enclosed thereby below a second one of said jackets and said tube bundle enclosed thereby; said means for passing a secondary fluid through said jackets including a secondary medium main inlet opening through said first jacket and positioned below and adjacent to the one of said tube sheets in which is mounted the outlet end of the tube bundle enclosed by this first jacket, said first jacket having a secondary medium intermediate outlet opening therefrom below and adjacent to the tube sheet in which is mounted the inlet end of the tube bundle enclosed by this first jacket, said second jacket having a secondary medium main outlet opening above and adjacent to the tube sheet in which is mounted the inlet end of the tube bundle enclosed by said second jacket, and an upper secondary medium intermediate inlet opening a substantial distance above the tube sheet in which is mounted the outlet end of the tube bundle enclosed by this second jacket and a lower secondary medium intermediate inlet opening above and adjacent to the tube sheet in which is mounted the outlet end of the tube bundle in this second jacket, a water separator chamber outside of said jackets and connecting the first jacket's said secondary medium intermediate outlet to the second jacket's said upper secondary medium intermediate inlet, and a vertical gravity conduit having an upper end connecting with said water separator chamber to receive separated water therefrom and a lower end connecting with the seocond jacket's said lower secondary medium intermediate inlet.

2. The generator of claim 1 having means for forcing the separated water from said gravity conduit's lower end into the second jackets said lower secondary medium intermediate inlet.

3. The generator of claim 1 in which said jackets, tube sheets and tube bundles form integrated units in each instance, and said connection chambers have means for connecting them to said units and which are releasable to permit transport of each unit separate from the other.

* * * * *